US010374283B2

(12) United States Patent
Terashima

(10) Patent No.: US 10,374,283 B2
(45) Date of Patent: Aug. 6, 2019

(54) COIL FOR ANTENNA AND ANTENNA SYSTEM

(71) Applicant: AGC INC., Tokyo (JP)

(72) Inventor: Fumitaka Terashima, Tokyo (JP)

(73) Assignee: AGC INC., Tokyo (JP)

( * ) Notice: Subject to any disclaimer, the term of this patent is extended or adjusted under 35 U.S.C. 154(b) by 152 days.

(21) Appl. No.: 15/374,680

(22) Filed: Dec. 9, 2016

(65) Prior Publication Data

US 2017/0093016 A1 Mar. 30, 2017

Related U.S. Application Data

(63) Continuation of application No. PCT/JP2015/065789, filed on Jun. 1, 2015.

(30) Foreign Application Priority Data

Jun. 24, 2014 (JP) ..... 2014-128966

(51) Int. Cl.

| | |
|---|---|
| ***H01Q 1/12*** | (2006.01) |
| ***H01F 5/00*** | (2006.01) |
| ***H01Q 1/32*** | (2006.01) |
| ***H01Q 1/48*** | (2006.01) |
| ***H01Q 7/08*** | (2006.01) |
| ***H01F 38/14*** | (2006.01) |

(52) U.S. Cl.

CPC ..... *H01Q 1/1278* (2013.01); *H01F 5/00* (2013.01); *H01F 38/14* (2013.01); *H01Q 1/3208* (2013.01); *H01Q 1/48* (2013.01); *H01Q 7/08* (2013.01)

(58) Field of Classification Search

CPC .. H01F 38/14; H01F 5/00; H01Q 7/08; H01Q 1/3208; H01Q 1/1278; H01Q 1/48

See application file for complete search history.

(56) References Cited

U.S. PATENT DOCUMENTS

| | | | |
|---|---|---|---|
| 4,063,247 | A | 12/1977 | Kaoru et al. |
| 5,565,833 | A | 10/1996 | Leet et al. |
| 5,629,711 | A | 5/1997 | Matsuoka et al. |

(Continued)

FOREIGN PATENT DOCUMENTS

| | | | |
|---|---|---|---|
| EP | 0 805 505 | A | 5/1997 |
| JP | S596602 | A | 1/1984 |

(Continued)

OTHER PUBLICATIONS

Partial Supplementary European Search Report dated Dec. 20, 2017 in corresponding application No. 15811387.8.

(Continued)

*Primary Examiner* — Daniel Munoz
*Assistant Examiner* — Awat M Salih
(74) *Attorney, Agent, or Firm* — Foley & Lardner LLP

(57) ABSTRACT

A coil for an antenna includes a ferrite core; and a winding conductor configured to have a conducting wire wound around the ferrite core as a core bar. The winding conductor includes an inner winding positioned inside when viewed from a plane perpendicular to the core bar, and an outer winding positioned outside of the inner winding. A length of the outer winding when viewed from a plane parallel to the core bar is different from a length of the inner winding.

15 Claims, 3 Drawing Sheets

(56) References Cited

U.S. PATENT DOCUMENTS

| | | | | |
|---|---|---|---|---|
| 5,781,160 | A * | 7/1998 | Walton | H01Q 1/1278 343/704 |
| RE37,835 | E | 9/2002 | Kropielnicki et al. | |
| 2006/0196984 | A1 | 9/2006 | Higeta | |
| 2007/0139976 | A1* | 6/2007 | deRochemont | B82Y 30/00 363/17 |
| 2008/0204337 | A1* | 8/2008 | Takaoka | H01Q 1/3241 343/722 |
| 2011/0241957 | A1 | 10/2011 | Ohara | |
| 2015/0138031 | A1* | 5/2015 | Van Gils | H01F 38/14 343/788 |

FOREIGN PATENT DOCUMENTS

| | | | |
|---|---|---|---|
| JP | H05-278460 | A | 10/1993 |
| JP | H06-152215 | A | 5/1994 |
| JP | H07-073796 | A | 3/1995 |
| JP | 2007-067171 | A | 3/2007 |
| JP | 2009-017300 | A | 1/2009 |

OTHER PUBLICATIONS

International Search Report issued in International Patent Application No. PCT/JP2015/065789 dated Aug. 11, 2015.

* cited by examiner

COIL FOR ANTENNA AND ANTENNA SYSTEM

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2015/065789 filed on Jun. 1, 2015 and designating the U.S., which claims priority of Japanese Patent Application No. 2014-128966 filed on Jun. 24, 2014. The entire contents of the foregoing applications are incorporated herein by reference.

BACKGROUND OF THE INVENTION

1. Field of the Invention

The present invention relates to a coil for an antenna and an antenna system.

2. Description of the Related Art

Conventionally, a technology has been known that uses an electrically-heated defogger as an antenna or a part of an antenna formed in a window glass for a vehicle, including multiple heater wires and bus bars connected to terminal parts of the wires to feed power.

In general, when a defogger is used as an antenna, coils are connected between a bus bar and a power supply, and between the bus bar and ground, respectively, to allow a direct current flowing, although a signal in a frequency band to be received by the defogger needs to be blocked.

However, since a relatively high current flows through the defogger, such as several amperes to several dozen amperes, it is necessary to provide a coil having a high current capacity that uses a thick conducting wire, and a problem has arisen in that the coil becomes larger as a whole, and has a greater weight.

For example, Patent Document 1 (Japanese Laid-open Patent Publication No. 2007-67171) discloses a coil that is downsized compared to a conventional coil having a single winding, by having the conductor wound by double windings. Further, this make it possible to shorten the length of a ferrite core to be inserted in the coil, and hence, to reduce the weight.

However, if using a coil having double windings as in the cited reference 1, the inner winding and the outer winding come close to each other in a part corresponding to the double windings. Therefore, capacitive coupling is formed between the inner winding and the outer winding, and this results in decreasing the impedance in a desired frequency band of the coil. Thus, a problem has arisen for simplistic use of a double-winding coil, in that a sufficient blocking performance is not obtained for a signal in a desired frequency band to be received by the defogger.

Thereupon, the present invention provides a coil for an antenna and an antenna system in which the size of the coil is small, and high impedance can be obtained in a desired frequency band.

SUMMARY OF THE INVENTION

According to an embodiment, a coil for an antenna includes a ferrite core; and a winding conductor configured to have a conducting wire wound around the ferrite core as a core bar. The winding conductor includes an inner winding positioned inside when viewed from a plane perpendicular to the core bar, and an outer winding positioned outside of the inner winding. A length of the outer winding when viewed from a plane parallel to the core bar is different from a length of the inner winding.

According to an embodiment of the present invention, a coil for an antenna and an antenna system are provided in which the size of the coil is small, and high impedance can be obtained in a desired frequency band.

Other objects, features and advantages of the present invention will become more apparent from the following detailed description when read in conjunction with the accompanying drawings.

DESCRIPTION OF THE PREFERRED EMBODIMENTS

Figure 1:
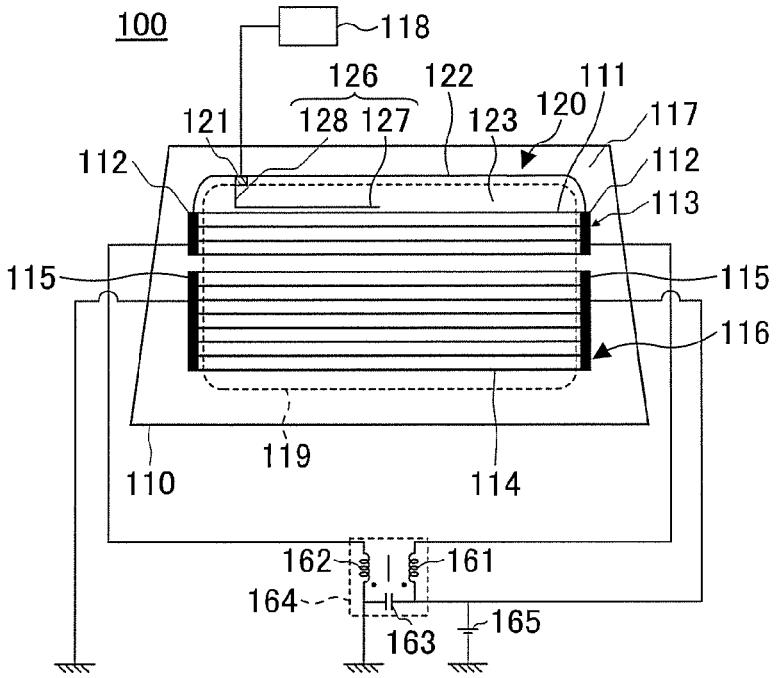
FIG. 1 is a diagram illustrating an example of a connection configuration of an antenna system in a case where a coil for an antenna according to an embodiment is attached to a window glass for a vehicle.

In the following, embodiments will be described with reference to the drawings. Note that in the drawings for describing the embodiments, parallel lines, orthogonal lines, and curvatures at corners may include shifts to an extent that effects of the present invention are not degraded. Also, the drawings of a window glass for a vehicle are diagrams of the window glass for the vehicle installed on the vehicle and viewed from the inside of the vehicle. However, they may be seen as diagrams viewed from the outside of the vehicle. Also, the left-and-right direction in the drawings corresponds to the vehicle width direction.

Note that in the following description of the embodiments, it is assumed that a frequency to be received by a defogger is in an AM band (520 to 1710 kHz). However, the characteristic of a coil is not limited as such, but the constants may be defined depending on a desired frequency.

<Description of Entire Antenna System using Coil Device>

FIG. 1 is a diagram illustrating an example of a connection configuration of an antenna system in a case where a coil for an antenna according to an embodiment is attached to a window glass for a vehicle.

A window glass for a vehicle 110 of a window glass for a vehicle with a glass antenna 100 includes electrically-heated defoggers (113, 116), first antenna conductors (122, 126), and a glass antenna 120 that includes a power feeding point 121 for the first antenna conductors.

The defoggers are partitioned up and down that include the first defogger 113 positioned upwards, and the second defogger 116 positioned below the first defogger 113. The first defogger 113 is constituted with first multiple heater wires 111 and a first pair of bus bars 112, and the second defogger 116 is constituted with second multiple heater wires 114 and a second pair of bus bars 115.

When viewed in a state attached to a vehicle, the first multiple heater wires 111 and the second multiple heater wires 114 extend in the left-and-right direction of the vehicle glass, and the first pair of bus bars 112 and the second pair of bus bars 115 extend in the up-and-down direction. The first multiple heater wires 111 have the first pair of bus bars 112 connected at both ends, and the second multiple heater wires 114 have the second pair of bus bars 115 connected at both ends. In a marginal part above the first defogger 113, the first antenna conductors are provided.

The first antenna conductors include an area forming element 122 and a first antenna element 126.

The area forming element 122 has both its terminal parts connected with the first pair of bus bars 112, and is disposed along the outer edges of the window glass for a vehicle, in an upper part in the marginal part of the first defogger 113, so as to form a blank area 123 that is enclosed by the first defogger 113 and the area forming element 122.

Note that it is desirable to dispose the area forming element 122 in an area hidden by a black shielding film 117, from the aesthetics point of view. The black shielding film 117 is disposed having a predetermined width from the outer edges of the window glass for a vehicle 110, and corresponds to an area in FIG. 1 between the outer edges of the window glass for a vehicle 110 and a dashed line (the peripheral portion of the black shielding film 119). The black shielding film 117 is disposed to prevent degradation of an adhesive at a junction part with a metal part of the vehicle body, and from the aesthetics point of view.

Note that although both terminal parts of the area forming element 122 are illustrated in FIG. 1 to be connected with the first pair of bus bars 112, respectively, either one or both of the terminal parts of the area forming element 122 may be connected with the first multiple heater wires 111 at arbitrary locations. In other words, the area forming element 122 just needs to be connected with the first defogger 113.

The first antenna element 126 is disposed on the inside of the blank area 123. The first antenna element 126 includes a first horizontal element 127 and a first connection element 128.

The first horizontal element 127 is positioned close to the first defogger 113, extends along the first defogger 113, and is connected with the power feeding point 121 via the first connection element 128.

By providing such a first antenna conductor that uses the first defogger 113 as a part of the antenna, antenna gain to be obtained increases.

Note that the configuration of the first antenna conductor is not limited to that in the embodiment. In other words, the first antenna conductor just needs to include an antenna element that is electrically connected with the first defogger 113. By having the first antenna conductor electrically connected with the first defogger 113, the antenna gain to be obtained improves in the antenna system.

Here, "electrically connected" is a notion that includes conduction at a high frequency between the first horizontal element 127 and the first defogger 113 separated by a predetermined interval to each other.

Also, the first horizontal element 127 may be directly connected with the power feeding point 121 without having the first connection element 128 intervening.

The power feeding point 121 is a part to have the first antenna conductor electrically connected with a signal processing circuit such as an amplifier 118 via a predetermined conductive member. As such a conductive member, for example, a power feeding wire such as an AV wire may be used. A configuration may be adopted in which a connector is mounted at the power feeding point 121, to have a signal processing circuit such as an amplifier electrically connected with the power feeding point 121. Such a connector makes it easier to have the AV wire or the like attached to the power feeding point 121. Also, another configuration may be adopted in which the power feeding point 121 includes a projecting conductive member that contacts and fits with a connection part disposed at a flange of the vehicle body to which the window glass for a vehicle 110 is attached. An electric signal amplified by the amplifier 118 is supplied to a receiver (not illustrated).

The vehicle includes an in-vehicle battery 165 to supply DC power. The first defogger 113 has a function to warm up the window glass for the vehicle and to prevent fogging on the window glass for the vehicle, by being heated up when a current flows from the in-vehicle battery 165 to ground, through the first pair of bus bars 112 and the first multiple heater wires 111. In the embodiment, coils are disposed between the in-vehicle battery 165 and the first defogger 113, and between the first defogger 113 and ground.

In FIG. 1, a coil device 164 is enclosed by a dotted line that represents a whole of two coils disposed between the in-vehicle battery 165 and the first defogger 113, and between the first defogger 113 and ground, and a capacitor 163. The coil device 164 is constituted with a first coil 161, a second coil 162, and the capacitor 163.

The first coil 161 and the second coil 162 allow a direct current to flow, but block a signal in a frequency band to be received by the defogger. In the embodiment, the first defogger 113 is used as the antenna, and it is assumed that the frequency to be received is in the AM band (520 to 1710 kHz). Therefore, the constants of the first coil 161 and the second coil 162 may need to be high impedance with respect to the AM band at least, and it is preferable to have the impedance of 4 kΩ or greater, covering the entire range of the AM band desirably, or 4.5 kΩ or greater further desirably.

The capacitor 163 prevents noise from the power source and wiring in the compartment from flowing in the first defogger 113 and the second defogger 116, to avoid the noise affecting the reception performance of the antenna. However, the configuration is not limited to that in the embodiment; if only a few noise comes from the power source, the capacitor 163 may not be provided.

As in the embodiment, it is preferable to have the pattern of the defoggers partitioned up and down, and to use a part of the defoggers as the antenna as described above, because a current capacity required for the first coil 161 and the second coil 162 can be reduced, and the coils can be further downsized by using linear, thin conducting wires.

<Description of Coil for Antenna>

Figure 2:
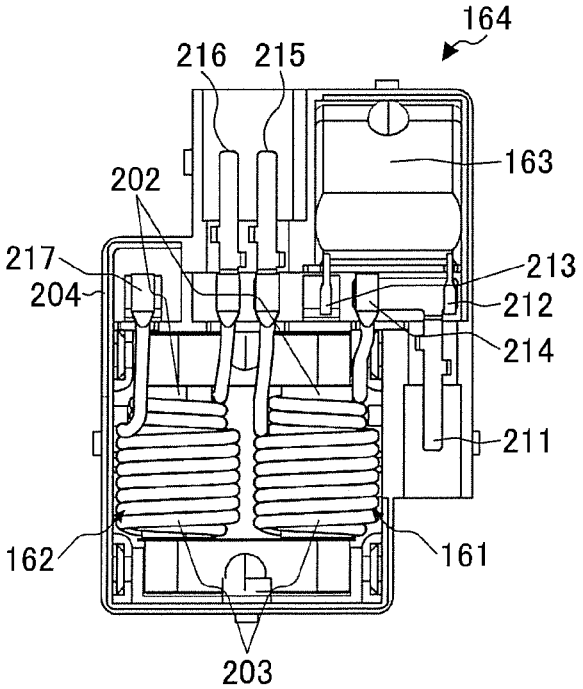
FIG. 2 is a plan view of a coil device that uses a coil for an antenna in the embodiment.

Next, an example of the configuration of the coil device 164 will be described. FIG. 2 is a plan view of the coil device 164 that uses the coils for the antenna according to the embodiment. As illustrated in FIG. 2, the coil device 164 includes ferrite cores 202, the first coil 161 and the second coil 162 constituted with the ferrite cores 202 as the core bars wound by winding conductors 203, respectively, an insulative base member 204 to hold these, and the capacitor 163.

The ferrite core 202 has a circular cross section, and is formed of two C-shaped (or one-side-lacking square-shaped) members joined in hollow parts of the winding conductors 203, to have a loop shape as a whole. In this case, the winding conductors 203 may be produced in advance by a jig so that the two C-shaped members are inserted from both terminal parts of the winding conductors 203, and joined. However, the ferrite core 202 is not limited to that in the embodiment, but may have, for example, a polygonal cross section, and may have a rod shape as a whole.

The first coil 161 and the second coil 162 have conducting wires wound by a desired number of turns around the ferrite core 202 formed in a cylindrical shape, and are fixed on the base member 204 by an adhesive or the like.

Also, the coil device 164 includes a first contact 211, a second contact 212, a third contact 213, a fourth contact 214, a fifth contact 215, a sixth contact 216, and a seventh contact 217.

Here, the first contact 211 connects the coil device 164 itself to the in-vehicle battery 165. The second contact 212 connects the in-vehicle battery 165 to the capacitor 163. The third contact 213 connects the capacitor 163 to ground. The fourth contact 214 connects the in-vehicle battery 165 to the first coil 161. The fifth contact 215 connects the first coil 161 to the first defogger 113. The sixth contact 216 connects the first defogger 113 to the second coil 162. The seventh contact 217 connects the second coil 162 to ground.

Figure 3:
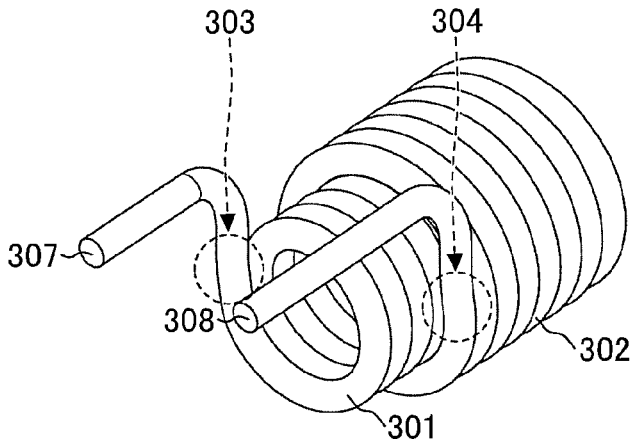
FIG. 3 is a perspective view of a winding conductor that forms a coil for an antenna in the embodiment.

Also, the first coil 161 and the second coil 162 are configured to have double windings of the conducting wires partially, and stages on the middle of the respective coils. Here, a perspective view of the winding conductor 203 that forms the coil is illustrated in FIG. 3; a diagram viewed from a plane parallel to the core bar of the coil is illustrated in FIG. 4; and a diagram viewed from a plane perpendicular to the core bar of the coil is illustrated in FIG. 5.

As illustrated in these figures, the winding conductor 203 includes an inner winding 301 positioned on the inside, and an outer winding 302 positioned on the outside.

Figure 4:
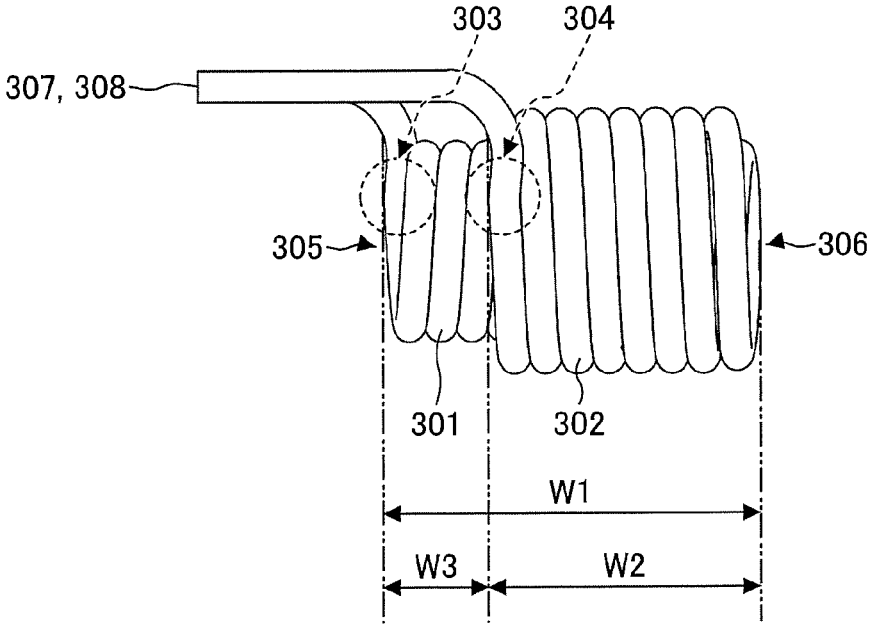
FIG. 4 is a diagram of a winding conductor viewed from a plane parallel to the core bar of a coil.
Figure 5:
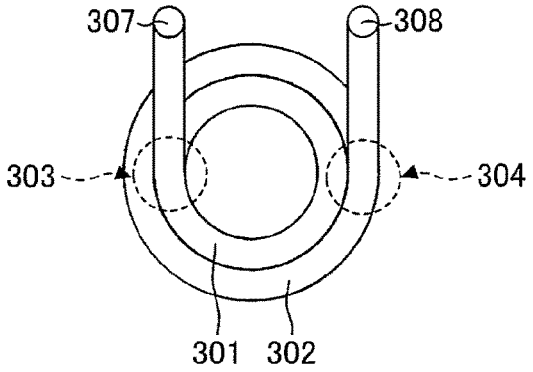
FIG. 5 is a diagram of a winding conductor viewed from a plane perpendicular to the core bar of the coil.

As illustrated in FIG. 4, when viewed from the plane parallel to the core bar of the coil, the inner winding 301 is disposed from a first terminal part 305 to a second terminal part 306 of the winding conductor 203, to form the total length of the winding conductor 203. In other words, a length W1 of the inner winding 301 is the total length of the winding conductor 203.

Here, the total length of the winding conductor 203 is not an unwound length of the conducting wire that is wound, but the total length in a state where the conducting wire is wound, namely, the total length in the lateral direction when viewed from the plane parallel to the core bar of the coil. Similarly, the length of the inner winding 301 or the outer winding 302 is not an unwound length of the conducting wire that is wound, but the length in a state where the conducting wire is wound when viewed from the parallel plane.

On the other hand, the outer winding 302 is a conducting wire continuous with the inner winding 301, wound in the direction from the second terminal part 306 to the first terminal part 305, and forms a length W2 of the outer winding 302. Here, the length W2 of the outer winding 302 is shorter than the total length of the winding conductor 203 (or the length of the inner winding 301) W1.

By making the length W2 of the outer winding 302 shorter than the length W1 of the inner winding 301 in this way, the length of a part where the inner winding 301 overlaps with the outer winding 302, namely, the length W2 can be made shorter with respect to the inner winding 301. Consequently, it is possible to prevent the impedance from decreasing in a desired frequency band due to capacitive coupling between the wound wires of the inner winding 301 and the outer winding 302.

It is desirable that the length of the outer winding 302 is greater than or equal to 40% and less than or equal to 95% of the length of the inner winding 301, preferably greater than or equal to 50% and less than or equal to 85%, and further preferably greater than or equal to 60% and less than or equal to 80%.

To make the length W2 of the outer winding 302 shorter than the length W1 of the inner winding 301, for example, the number of turns of the outer winding 302 may be set fewer than the number of turns of the inner winding 301. It is desirable that the number of turns of the outer winding 302 is greater than or equal to 40% and less than or equal to 95% of the number of turns of the inner winding 301, preferably greater than or equal to 50% and less than or equal to 85%, and further preferably greater than or equal to 60% and less than or equal to 80%.

Also, a start point 303 of winding the winding conductor 203 is disposed apart from an end point 304 of winding the winding conductor 203, by a distance W3. If the start point 303 and the end point 304 exist at closer positions (for example, W3≈0), capacitive coupling between the start point 303 and the end point 304 becomes greater, and the impedance tends to decrease in a desired frequency band. Therefore, by disposing the start point 303 apart from the end point 304, it is possible to reduce the capacitive coupling between the start point 303 and the end point 304, and further, to prevent the impedance from decreasing in the desired frequency band.

It is preferable that the start point 303 is disposed at the first terminal part 305, and the end point 304 is disposed between the first terminal part 305 and the second terminal part 306. Also, it is desirable that the distance W3 between the start point 303 and the end point 304 is greater than or equal to 5% and less than or equal to 60% of the total length of the winding conductor, preferably greater than or equal to 15% and less than or equal to 50%, and further preferably greater than or equal to 20% and less than or equal to 40%.

Also, a first connection point 307 and a second connection point 308 of the winding conductor 203 are disposed on the side of the first terminal part 305. In this way, by disposing the first connection point 307 and the second connection point 308 on the same terminal part side, it is possible to simplify assembly work of putting them together as the coil device 164.

Note that in the embodiment, although an example has been described in which the inner winding 301 constitutes the total length of the winding conductor 203, and the outer winding 302 has a length shorter than the total length of the winding conductor 203, the configuration is not limited to the example in the embodiment. In other words, a configuration is possible in which the outer winding 302 constitutes the total length of the winding conductor 203, and the inner winding 301 has a length shorter than the total length of the winding conductor 203 when wound. In this case, a relationship between the inner winding 301 and the outer winding 302 in terms of the lengths in the lateral direction viewed from the plane parallel to the cores of the coils, and the numbers of turns, may be substantially the same as the relationship between the outer winding 302 and the inner winding 301 as described above.

Note that in the embodiment, although a two-stage configuration has been described in which the outer winding 302 is wound on the outside of the inner winding 301, the configuration is not limited to that in the embodiment. In other words, a configuration is possible in which the conducting wire is further wound on the outside of the outer winding 302 to form the winding conductor 203 having three or more stages.

For example, if such a second outer winding is disposed on the outside of the outer winding 302 in a direction from the end of winding the outer winding 302 to the second terminal part 306, the start point 303 can be further apart from the end point 304, which is preferable. Also, in this case, if the total length of the conducting wire that constitutes the winding conductor 203 remains the same, compared to the winding conductor 203 having two stages, the total length of the winding conductor 203 in the lateral direction viewed from the plane parallel to the core bar of the coil can be further shortened, and hence, the total length of the coils and the length of the ferrite cores 202 can be made further shorter, with which further downsizing and lighter weight can be realized.

Also, if the second outer winding is disposed, although the second outer winding is wound in a direction going away from the first connection point 307, it is preferable to have the second connection point 308 formed on the side of the first connection point 307 because gathering the connection points in one direction makes the assembly work easier.

APPLICATION EXAMPLE

Next, actual measurement results of the impedance of the coil for the antenna in the embodiment will be described.

Figure 6:
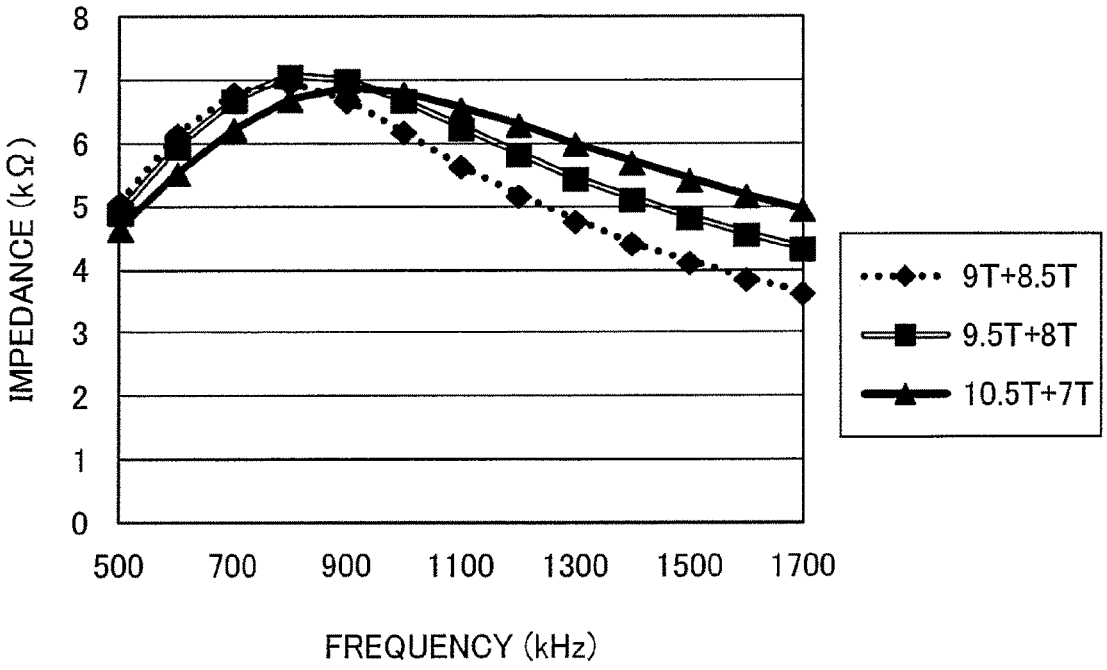
FIG. 6 is a diagram illustrating characteristics of a coil for an antenna according to the embodiment.

As the coil for the antenna, three types of coils are provided that have different numbers of turns of the conducting wire, and the impedance of these coils was measured in the AM band. Each coil has 17.5 turns in total of the inner winding 301 and the outer winding 302. In FIG. 6, "9T+8.5T" represents 9 turns in the inner winding 301 plus 8.5 turns in the outer winding 302. Similarly, "9.5T+8T" represents 9.5 turns in the inner winding 301 plus 8 turns in the outer winding 302, and "10.5T+7T" represents 10.5 turns in the inner winding 301 plus 7 turns in the outer winding 302.

Note that winding the outer winding 302 is set to start at the second terminal part 306, namely, the distances W3 between the start point 303 and the end point 304 are arranged in ascending order for "9T+8.5T", "9.5T+8T", and "10.5T+7T".

It was understood from the results in FIG. 6 that the impedance improves more in the AM band for the coil device 164, with a configuration having a fewer number of turns of the outer winding 302.

So far, the preferable embodiments and the application examples have been described in detail. Note that the present invention is not limited to the embodiments and application examples described above, but various modifications and changes can be made within the scope of the subject matters described in the claims.

INDUSTRIAL USABILITY

The present invention is favorably used as a coil for an antenna, and an antenna system, especially those installed in vehicle glass.

The invention claimed is:

1. A coil for an antenna, comprising:

a ferrite core; and a winding conductor configured to have a conducting wire wound around the ferrite core as a core bar, wherein the winding conductor includes an inner winding positioned inside when viewed from a plane perpendicular to the core bar, and an outer winding positioned outside of the inner winding, wherein a length of the outer winding when viewed from a plane parallel to the core bar is different from a length of the inner winding, wherein the outer winding is the conducting wire continuous with the inner winding, and wherein the coil has an impedance of 4 kΩ or greater with respect to an entire range of an AM band.

2. The coil for the antenna as claimed in claim 1, wherein the length of the outer winding when viewed from the plane parallel to the core bar is shorter than the length of the inner winding.

3. The coil for the antenna as claimed in claim 2, wherein the length of the outer winding is greater than or equal to 50% and less than or equal to 85% of the length of the inner winding.

4. The coil for the antenna as claimed in claim 2, wherein a number of turns of the conducting wire of the outer winding is greater than or equal to 50% and less than or equal to 85% of a number of turns of the conducting wire of the inner winding.

5. The coil for the antenna as claimed in claim 2, wherein the length of the outer winding is in a range from 40% to 90% of the length of the inner winding.

6. The coil for the antenna as claimed in claim 2, wherein the length of the outer winding is in a range from 60% to 80% of the length of the inner winding.

7. The coil for the antenna as claimed in claim 2, wherein the number of turns of the conducting wire of the outer winding is in a range from 40% to 95% of the number of turns of the conducting wire of the inner winding.

8. The coil for the antenna as claimed in claim 2, wherein the number of turns of the conducting wire of the outer winding is in a range from 60% to 80% of the number of turns of the conducting wire of the inner winding.

9. The coil for the antenna as claimed in claim 1, wherein the winding conductor has a start point of the conducting wire at which winding starts, and an end point of the conducting wire at which the winding ends, wherein a distance between the start point and the end point when viewed from the plane parallel to the core bar is in a range from 5% to 60% of a total length of the winding conductor.

10. The coil for the antenna as claimed in claim 9, wherein the distance between the start point and the end point is in a range from 15% to 50% of the total length of the winding conductor.

11. The coil for the antenna as claimed in claim 9, wherein the distance between the start point and the end point is in a range from 20% to 40% of the total length of the winding conductor.

12. An antenna system comprising:

a glass antenna for a vehicle configured to be disposed in a window glass plate of the vehicle, and to include a defogger including multiple heater wires, and a pair of bus bars to which terminal parts of the heater wires are connected, an antenna conductor, and a power feeding point for the antenna conductor, in the window glass plate of the vehicle, wherein the defogger is heated up by a current flowing from a power source to a ground through the bus bars and the heater wires, wherein the antenna conductor is electrically connected with the defogger, wherein a coil device is disposed in which the coil for the antenna as claimed in claim 1 is connected between the defogger and the power source, and between the defogger and the ground, respectively.

13. The antenna system as claimed in claim 12, wherein the defogger is partitioned up and down to include a first defogger including first multiple heater wires and a first pair of bus bars, and a second defogger including second multiple heater wires and a second pair of bus bars, wherein the antenna conductor is electrically connected with at least one of the first defogger and the second defogger, wherein the coil device is disposed between both or one of the first defogger and the second defogger electrically connected with the antenna conductor, and the power source and the ground.

14. The coil for the antenna as claimed in claim 1, wherein the conducting wire is further wound on the outside of the outer winding to form the winding conductor having three or more stages.

15. The coil for the antenna as claimed in claim 1, wherein the coil has the impedance of 4.5 kΩ or greater with respect to the entire range of the AM band.

* * * * *